US010040608B2

(12) United States Patent
Olson et al.

(10) Patent No.: US 10,040,608 B2
(45) Date of Patent: Aug. 7, 2018

(54) METAL BOTTLE SEAL

(71) Applicant: STOLLE MACHINERY COMPANY, LLC, Centennial, CO (US)

(72) Inventors: Christopher J. Olson, New Castle, CO (US); Edmund Gillest, Arvada, CO (US)

(73) Assignee: STOLLE MACHINERY COMPANY, LLC, Centennial, CO (US)

( * ) Notice: Subject to any disclaimer, the term of this patent is extended or adjusted under 35 U.S.C. 154(b) by 0 days.

(21) Appl. No.: 15/614,669

(22) Filed: Jun. 6, 2017

(65) Prior Publication Data

US 2017/0267415 A1 Sep. 21, 2017

Related U.S. Application Data

(63) Continuation of application No. 15/150,747, filed on May 10, 2016, now Pat. No. 9,694,947, which is a (Continued)

(51) Int. Cl.
*B65D 1/02* (2006.01)
*B65D 1/46* (2006.01)
(Continued)

(52) U.S. Cl.
CPC ..... *B65D 41/125* (2013.01); *B65D 1/0238* (2013.01); *B65D 1/0246* (2013.01);
(Continued)

(58) Field of Classification Search
CPC .. B65D 1/0246; B65D 23/08; B65D 43/0237; B65D 41/125; B65D 1/0238;
(Continued)

(56) References Cited

U.S. PATENT DOCUMENTS

RE6,583 E 8/1875 Beardsley
340,027 A 4/1886 Allen
(Continued)

OTHER PUBLICATIONS

VynaFlex Plastisol Compounds website; www.vynaflex.com; Aug. 9, 2006.

(Continued)

*Primary Examiner* — J. Gregory Pickett
*Assistant Examiner* — Niki M Eloshway
(74) *Attorney, Agent, or Firm* — Eckert Seamans Cherin & Mellott, LLC

(57) ABSTRACT

Disclosed is a metal bottle seal that is disposed on the curl of the metal bottle. The bottle seal may be held in place by crimping of the curl. In addition, adhesive may be used to hold the bottle seal on the curl. Adhesives can be used that fill discontinuities that may exist in the curl as a result of substantial drawing and ironing of the metal. Further, the metal bottle seal can be made of a material or laminated with a material that is soft enough to fill the discontinuities. The seal can be preformed as a continuous annulus for easy application to the top of the metal bottle. The metal bottle seal can also be used in conjunction with a cap seal to ensure an adequate and reliable seal.

18 Claims, 15 Drawing Sheets

Related U.S. Application Data continuation of application No. 11/843,265, filed on Aug. 22, 2007, now abandoned.

(60) Provisional application No. 60/823,122, filed on Aug. 22, 2006.

(51) Int. Cl.

| | |
|---|---|
| ***B65D 1/48*** | (2006.01) |
| ***B65D 41/12*** | (2006.01) |
| ***B65D 51/20*** | (2006.01) |
| *B65D 1/42* | (2006.01) |

(52) U.S. Cl.

CPC ..... *B65D 41/12* (2013.01); *B65D 51/20* (2013.01); *B65D 2251/0015* (2013.01); *B65D 2251/0093* (2013.01)

(58) Field of Classification Search

CPC ..... B65D 41/12; B65D 51/20; B65D 2251/00015; B65D 2251/0093; B29B 2911/1402

USPC ..... 215/40, 43, 44, 45, 42, 356, 329, 341; 220/718, 700, 701, 729, 733, 640, 641, 220/642, 310.1, 362, 619, 716

See application file for complete search history.

(56) References Cited

U.S. PATENT DOCUMENTS

| | | | | |
|---|---|---|---|---|
| 715,397 | A | 12/1902 | Livingston | |
| 1,225,876 | A | 5/1917 | Silk | |
| 1,256,933 | A | 2/1918 | Schriner | |
| 1,409,336 | A | 3/1922 | Fahlman | |
| 2,682,359 | A | 6/1954 | Wigert | |
| 3,051,580 | A | 8/1962 | Brennan | |
| 3,343,579 | A | 9/1967 | Clark | |
| 3,367,533 | A | 2/1968 | Baker | |
| 3,656,668 | A | 4/1972 | Liebertz | |
| 3,680,745 | A | 8/1972 | Landen | |
| 3,700,133 | A | 10/1972 | Bagguley | |
| 3,774,560 | A | 11/1973 | Hartz | |
| 3,995,572 | A | 12/1976 | Saunders | |
| 4,403,493 | A | 9/1983 | Atkinson | |
| 4,423,823 | A | 1/1984 | Franek et al. | |
| 4,452,368 | A * | 6/1984 | Roth | B65D 7/38 220/612 |
| 4,543,025 | A | 9/1985 | Tsukamura | |
| 4,671,421 | A * | 6/1987 | Reiber | B65D 1/46 215/228 |
| 4,757,936 | A | 7/1988 | Homma et al. | |
| 4,852,793 | A | 8/1989 | Homma et al. | |
| 4,863,063 | A | 9/1989 | Imazu et al. | |
| 5,105,961 | A | 4/1992 | Noren et al. | |
| 5,138,858 | A | 8/1992 | Johnson et al. | |
| 5,178,297 | A | 1/1993 | Harold | |
| 5,190,209 | A | 3/1993 | Gordon et al. | |
| 5,226,586 | A | 7/1993 | Grone | |
| 5,293,765 | A | 3/1994 | Nussbaum-Pogacnik | |
| 5,448,903 | A | 9/1995 | Johnson | |
| 5,469,729 | A | 11/1995 | Hager | |
| 5,557,963 | A | 9/1996 | Diekhoff | |
| 5,595,322 | A | 1/1997 | Kramer | |
| 5,718,352 | A | 2/1998 | Diekhoff et al. | |
| 5,755,354 | A | 5/1998 | Lang | |
| 5,778,723 | A | 7/1998 | Diekhoff | |
| 5,822,843 | A | 10/1998 | Diekhoff et al. | |
| 5,911,332 | A | 6/1999 | Wickland et al. | |
| 5,915,587 | A | 6/1999 | Kramer | |
| 5,947,309 | A | 9/1999 | Anderson | |
| 5,951,794 | A | 9/1999 | Dickson, Jr. | |
| 6,010,026 | A | 1/2000 | Diekhoff et al. | |
| 6,010,028 | A | 1/2000 | Jordan et al. | |
| 6,170,144 | B1 | 1/2001 | Phillipson | |
| D442,865 | S | 5/2001 | Lang | |
| 6,375,020 | B1 * | 4/2002 | Marquez | B65D 1/0207 215/232 |
| 6,484,550 | B2 | 11/2002 | Halasz et al. | |
| 6,543,636 | B1 | 4/2003 | Flecheux et al. | |
| 6,779,677 | B2 | 8/2004 | Chupak | |
| 6,857,304 | B2 | 2/2005 | Enoki | |
| 6,907,653 | B2 | 6/2005 | Chupak | |
| 6,959,830 | B1 | 11/2005 | Kanou | |
| 7,014,060 | B2 | 3/2006 | Richardson | |
| 7,156,252 | B2 | 1/2007 | Morin | |
| 7,997,440 | B2 * | 8/2011 | Baughman | B65D 39/084 220/254.8 |
| 2003/0116521 | A1 | 6/2003 | Chupak | |
| 2003/0116579 | A1 | 6/2003 | Chambers | |
| 2004/0256346 | A1 | 12/2004 | Becker et al. | |
| 2005/0127077 | A1 | 6/2005 | Chupak | |
| 2005/0205575 | A1 | 9/2005 | Kobayashi et al. | |
| 2006/0277957 | A1 | 12/2006 | Fujishige | |
| 2010/0326949 | A1 * | 12/2010 | Merino Caballero | B65D 53/04 215/316 |
| 2015/0129592 | A1 * | 5/2015 | Staples | B65D 41/0407 220/254.7 |
| 2015/0225107 | A1 * | 8/2015 | Ross | B65D 39/08 215/44 |

OTHER PUBLICATIONS

"Making D&I truly scaleable," CanTech International, Jan./Feb. 2006.

"Small acorns, Technology for making D&I cans economically without the need for high production capacities is being launched by Omnitech International," John Nutting, The Canmaker, Feb. 2006.

* cited by examiner

METAL BOTTLE SEAL

CROSS REFERENCE TO RELATED APPLICATION

This application is a continuation of application Ser. No. 15/150,747, filed on May 10, 2016, and entitled "METAL BOTTLE SEAL"; which claims the benefit of application Ser. No. 11/843,265, filed on Aug. 22, 2007, and entitled "METAL BOTTLE SEAL"; which claims the benefit of Provisional Application No. 60/823,122, filed on Aug. 22, 2006 and entitled, "METAL BOTTLE SEAL." the contents of which are incorporated herein by reference.

BACKGROUND

There has been a great deal of interest in developing technology to support the introduction of metal containers, formed in such a way to allow the shape and finish to accept a bottle closure such as a crown cap or a roll-on/twist-off cap. Such containers are commonly known as metal bottles. There has been a great deal of difficulty encountered in providing a twist-off cap that is capable of providing a suitable and reliable seal that provides a high degree of integrity, and in the case of a screw-on cap, will allow the user to adequately reseal the metal bottle.

SUMMARY

An embodiment of the present invention may comprise a sealing system comprising: a bottle seal formed in the shape of an annulus that is made from a material suitable for creating a seal with a closure; a metal bottle that is shaped to form a bottle neck, the bottle neck having a curl formed in an edge of the bottle neck, the curl formed in a crimped configuration that mechanically holds the bottle seal on the curl; an adhesive disposed between the bottle seal and the curl that fills discontinuities in the curl and holds the bottle seal on the curl.

An embodiment of the present invention may further comprise a method of sealing a metal bottle comprising: providing a metal bottle having a curl formed in the upper edge of the metal bottle; placing a bottle seal on the curl so that a portion of the bottle seal wraps around the curl; crimping the curl to mechanically secure the bottle seal to the curl.

An embodiment of the present invention may further comprise a sealing system comprising: a metal bottle that is shaped to form a bottle neck, the bottle neck having a curl formed in an edge of the bottle neck; a bottle seal formed in the shape of an annulus that is made from a first layer that has a predetermined softness and a predetermined thickness that is sufficient to substantially fill discontinuities in the curl, and a second layer that is attached to the first layer that is made from a material suitable for creating a seal with a bottle cap, the bottle seal disposed between the curl and the metal bottle, the curl formed in a crimped configuration that mechanically holds the bottle seal on the curl.

An embodiment of the present invention may further comprise a sealing system comprising: a metal bottle that is shaped to form a bottle neck, the bottle neck having a curl formed in an edge of the bottle neck; a bottle seal formed in the shape of annulus that is made from a material that is suitable for creating a seal with a cap closure that is attached to the curl in the metal bottle.

DESCRIPTION OF THE PREFERRED EMBODIMENTS

Figure 1:
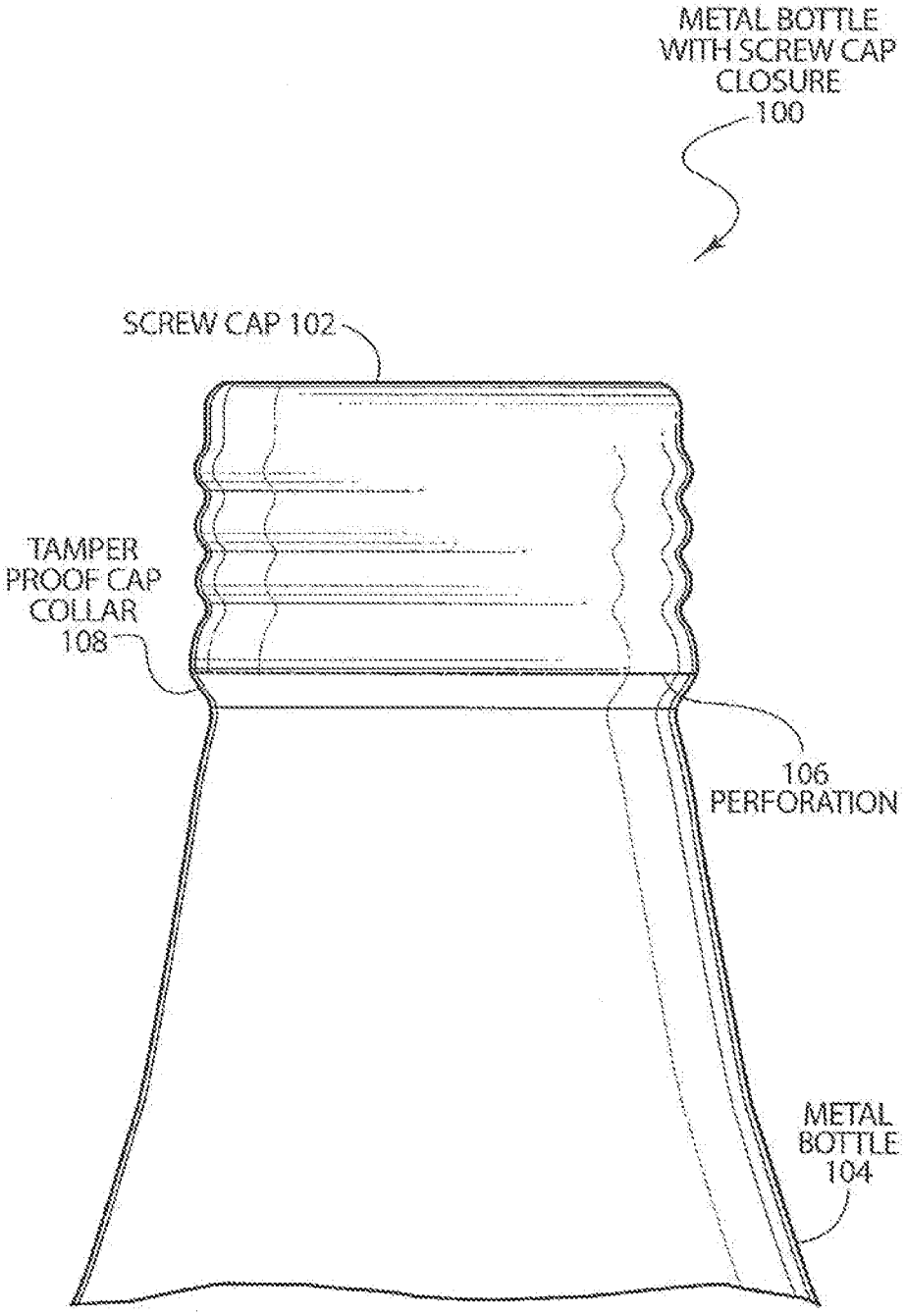
FIG. 1 is a schematic illustration of a metal bottle with a screw cap that includes the innovative seal of the present invention.

FIG. 1 is a schematic side view of a metal bottle having a closure such as a screw cap that incorporates the seal (not shown) of the present invention. As shown in FIG. 1, a screw cap 102, including a tamperproof cap collar 108 (roll on closure or pilfer-proof closure), is rolled onto and formed to the threads of metal bottle 104. In accordance with this process, a straight sidewall cap is slipped over the metal bottle 104. Screw threads are pre-formed in the metal bottle 104. A downward pressure is then placed on the top of the screw cap 102 which is sufficient to create pressure on the seal between the screw cap 102 and metal bottle 104. In conventional screw cap metal bottles, pressures of approximately 300 pounds per square inch are required to form an adequate seal.

In order to seal the cap, a roller then rotates around the outer surface of the metal screw cap 102 to force the straight sidewalls of the metal screw cap 102 to conform with the threads of the metal bottle and to form the tamperproof collar 108 so that the tamperproof collar 108 surrounds a ridge below the threads of the bottle. A perforation 106 is provided in the screw cap 102 so that the tamperproof cap collar 108 separates from the screw cap 102 when the screw cap 102 is twisted off. The screw cap 102 is forced inwardly by the roller to create threads in the screw cap 102 that conform to the threads of the metal bottle 104. If a different type of closure such as a crown is placed on the metal bottle 104, downward pressures on the crown may be double the amount required for a screw cap. These downward pressures necessary to create a seal using conventional compression seals would otherwise require the metal bottle to have sufficient structural rigidity to withstand the substantially high downward pressures. Hence, these substantially high downward pressures limit the thinness of the metal bottle and thereby limit the cost savings and lighter weight that can ideally be achieved using a metal bottle.

Figure 2:
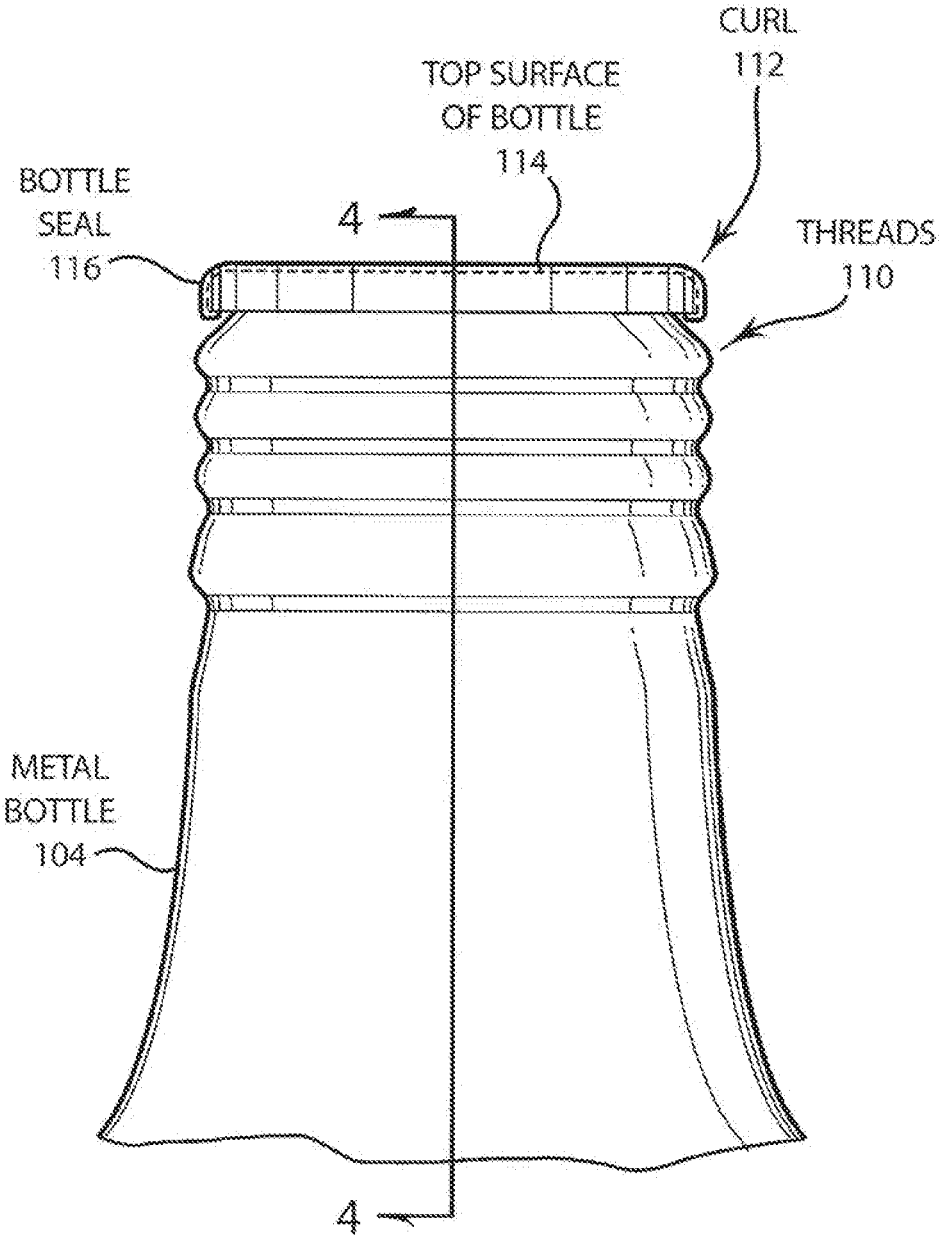
FIG. 2 is a schematic side view of a metal bottle that is formed with a sealing surface in accordance with the present invention.

Further, in order to form an opening for a metal bottle that has a diameter suitable for application of a conventional metal screw cap, as illustrated in FIG. 1, a substantial amount of drawing and ironing (D&I) of the top of the metal bottle is required. This amount of drawing and ironing of the metal work-hardens the metal and may cause cracks and splits in the metal, especially along the curl 112 (FIG. 2). These discontinuities may result in the lack of a proper seal if a cap seal is used to create a seal with the curl 112.

FIG. 2 is a schematic side view of metal bottle 104 that illustrates one embodiment of the present invention. As shown in FIG. 2, metal bottle 104 has a series of threads 110 that are formed in the upper neck portion of the metal bottle 104. The metal bottle 104 is then drawn and ironed from the larger diameter of the mid-portion of the metal bottle 104 to a diameter suitable for use with a conventional screw cap, as shown in FIG. 1. In addition, a curl 112 is formed from the metal at the top of the bottle neck, as shown in FIG. 2. This causes additional work-hardening of the metal and can create an uneven surface on the sealing surface 114. For example, cracks and splits may form in the metal along the sealing surface 114 of the metal bottle 104. It is necessary to have a smooth, surface in order to create a reliable and predictable seal between the sealing surface 114 and a bottle cap seal. One of the advantages of the metal bottle of the embodiments disclosed herein is the recycleability of aluminum and the substantial weight advantage over glass bottles. However, because of the cracking that can occur along the sealing surface 114, if the metal bottle seal is not used, the yield can be affected, which adds to the cost of using a metal bottle, and thereby diminishes one of the advantages of using a metal bottle that does not include a bottle seal. As set forth above, the substantial downward pressures that are required to make a compression contact seal with a normal bottle cap seal require additional structural rigidity of the metal bottle. Additional rigidity requires additional metal in the bottle. Additional metal in the metal bottle increases costs and adds weight. It would be desirable to have a metal bottle that is less expensive and is light weight. Of course, there are other advantages to using a metal bottle in comparison to a plastic bottle, including the longer shelf life and recycleability that can be achieved using a metal bottle and the appealing look that a sleek metal bottle provides.

Prior to shaping the metal bottle 104, a FDA approved coating is placed on the interior portion of the metal bottle 104. FDA approved coatings are required to seal the inner surface of the metal bottle 104 and isolate the metal, such as aluminum or steel, from the product. The FDA approved coating also assists in the metal shaping processes that are used to form the bottle neck that may include drawing and ironing, shaping, necking, and top forming. However, the substantial working of the metal that is required to shape the metal bottle to the diameter illustrated in FIG. 2, and the process of creating the curl 112 in the metal bottle, can create substantial damage to the FDA coating and potentially damage the coating and potentially leave damaged or weak spots where the contents of the bottle could contact the metal of the metal bottle 104. Repair of these damaged or weakened spots in the FDA coating are normally expensive and difficult. Existing resprayers can recoat the inside of the bottle to some extent, but repairing the outside portions, such as the sealing surface 114 and curl 112 is difficult. Further, resealing outside surfaces of the container may cause contamination, and the integrity of the closure may not be achieved. If an adequate and reliable seal is not achieved, spoilage can occur, which is very expensive.

To overcome these problems of creating a reliable and predictable seal, increasing the yield of metal bottles and allowing reduction of material thickness that approaches current can technology so that the cost savings of a bottle can be achieved, a bottle seal 116 is placed over the curl 112 that extends over the top sealing surface 114 to an interior portion of the metal bottle 104 in accordance with the embodiment of FIG. 2. The bottle seal 116 can be made from a material that is sufficiently soft and has a sufficient thickness to fill any discontinuities, cracks, apertures or other problems that exist on the sealing surface 114 while maintaining sufficient hardness to create an adequate seal. The bottle seal 116 can be preformed and press fit over curl 112 or heat molded onto curl 112. A material can be used for the bottle seal 112 that adheres to the metal of curl 112 when heated. Alternatively, a glue, such as a hot melt glue, can be coated on the interior surface of the bottle seal 116 prior to the seal being applied to the top of the metal bottle 104. The hot melt adhesive 122 (FIG. 5) can then be heated and pressed onto the top of the metal bottle 104, which forces the hot melt glue into any discontinuities on the sealing surface 114 and creates a flat surface along the top of the bottle seal 116. Of course, other types of adhesives and glues can be used with either type of seal described above. Suitable materials for use as a bottle seal 116 include polyethylene terephthalate (PET), PVC, urethane, thermoplastic rubber, silicon, plastisol, polyester, vinyl, epoxy, acrylic, organisol and other plastic materials. Suitable thicknesses for the seal vary with the particular material. Some materials may range in thicknesses from 30 microns to 200 microns, however. These bottle seal materials can be sprayed on to the curl 112.

Figure 3:
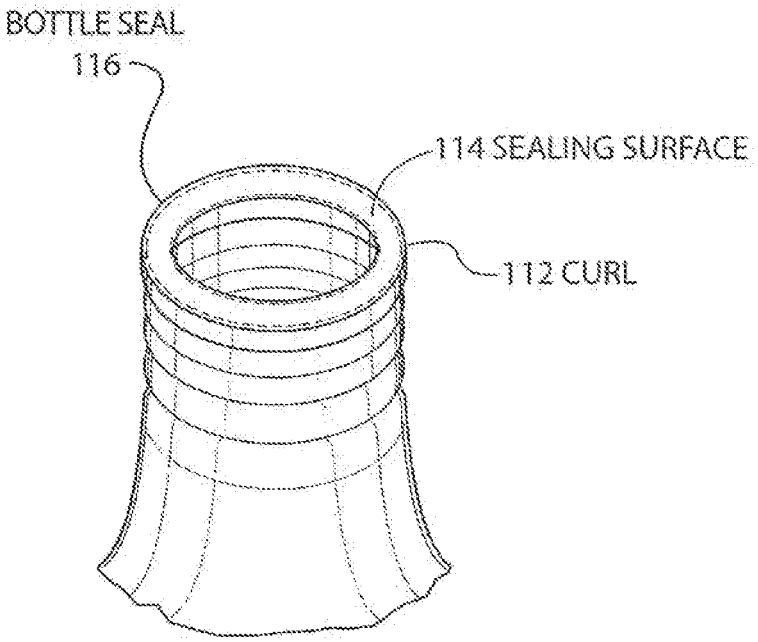
FIG. 3 is an isometric view of the top of a metal bottle such as illustrated in FIG. 2.

FIG. 3 is an isometric view of the top of the metal bottle 104. As shown in FIG. 3, a curl 112 is formed in the top edge of the metal on the neck of the bottle. Curl 112 has a top surface that is intended for use as a sealing surface 114. The bottle seal 116 is placed over the sealing surface 114 as described above.

Figure 4:
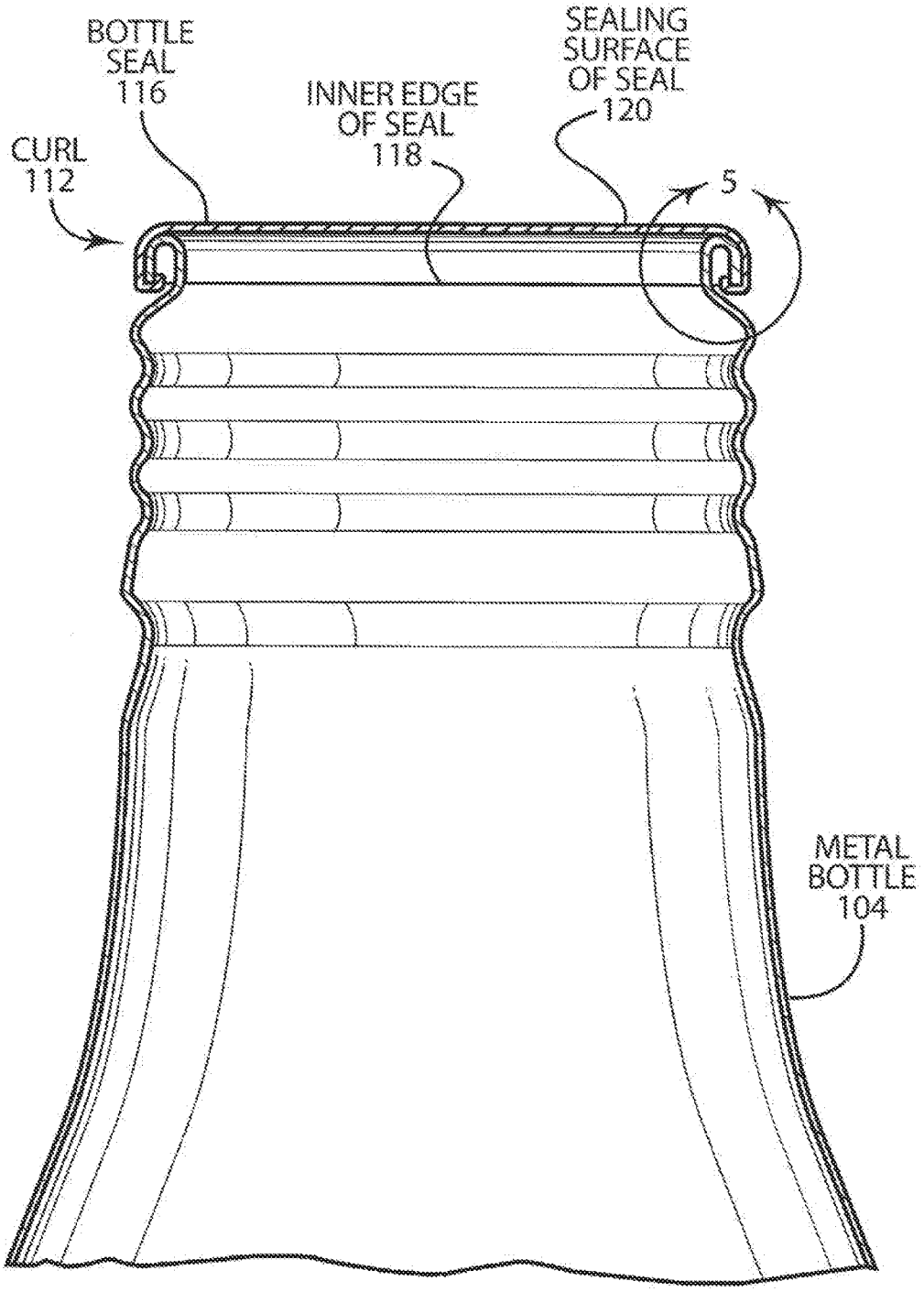
FIG. 4 is a schematic cutaway view of the bottle illustrated in FIG. 2.

FIG. 4 is a schematic cutaway view of the neck of the metal bottle 104. As shown in FIG. 4, a curl 112 is formed in the metal at the top of the bottle neck. The bottle seal 116 is wrapped around the curl, across the sealing surface of the curl, and extends inside the bottle as shown by edge of seal 118. The bottle seal 116 may have a preformed curvature or may be flat and wrapped around the curl. If the bottle seal 116 is pre-shaped, a J-hook can be formed in the bottle seal to engage the bottom of the curl. This is shown in greater detail in FIG. 6. Also, the bottle seal 116 may constitute a continuous annulus that can be preformed or partially preformed to fit in the opening of the metal bottle 104. By providing a continuous annulus, seams do not exist in the bottle seal 116 which prevents a discontinuity or a potential source of leakage in the seal. The annulus can be formed by cutting out rings from a sheet of the seal material and either preforming the seal material, or forming the seal on the metal bottle during application. Pressure-sensitive adhesives can be used on the seal to apply and form the bottle seal 116 to the curl 112 and sealing surface 114 so that the bottle seal 116 extends around to the inside of the bottle to the edge 118. The advantage of using a pressure-sensitive adhesive is that the bottle seal 116 can be progressively applied to the curl 112 and sealing surface 114.

In accordance with one embodiment, if the material of the bottle seal 116 is sufficiently soft, discontinuities in the sealing surface 114 of the metal bottle 104 will be filled. In addition, the bottle seal 116 can be made of layers of different materials that are laminated or sealed together. For example, the lower portion of the bottle seal 116 may be a softer material having a pressure-sensitive adhesive applied on its surface for application to the curl 112 and sealing surface 114, and a harder laminated sealing material can be used as a top layer that interfaces with the bottle cap to create a compression contact seal. Of course, various materials can be used to create a reliable and predictable compression contact seal between the bottle seal 116 and the screw cap 102. Such materials may reduce the downward pressures that is required during the placement of the screw cap 102 on the metal bottle 104, which in turn allows thinner sidewalls in the metal bottle 102 and thereby increases the advantages of using a metal bottle.

Figure 5:
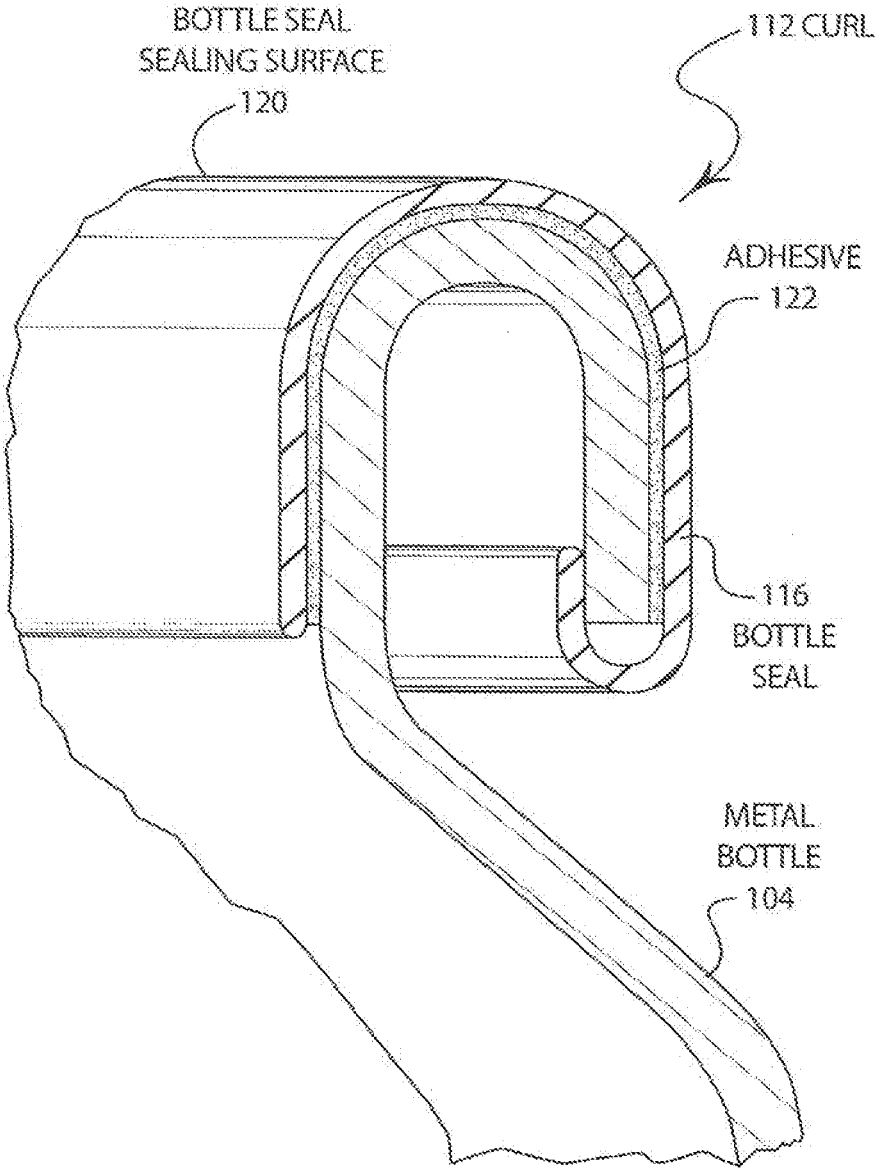
FIG. 5 is an exploded view from FIG. 4 illustrating the uncrimped curl in seal.

FIG. 5 is a close up cutaway view of curl 112 and bottle seal 116. As shown in FIG. 5, the bottle seal has a J-hook that can be preformed along one edge of the annulus of the bottle seal 116. Alternatively, the edge of the annulus of the bottle seal 116 can be folded under the curl 112 and attached in any manner desired, including the use of a pressure-sensitive adhesive (not shown). In accordance of one embodiment of the invention, an adhesive 122 is used to seal and hold the bottle seal 116 to the curl 112. For example, but not by way of limitation, the adhesive can comprise a hot melt adhesive that is pre-coated onto the back of the bottle seal 116. Such a hot melt adhesive has a thickness that is sufficient to fill any discontinuities in the outer surface of the curl 112, such as cracks or splits that result from work-hardening of the metal, while maintaining the structural integrity and flatness of the bottle seal 116 along the outer sealing surface. Once the bottle seal 116 is applied to the curl 112 as shown, the upper portion of the metal bottle 104, the curl and the bottle seal 116 can be heated to melt the hot melt adhesive. A slight downward pressure from a flat surface on the bottle seal sealing surface 120 will cause the hot melt adhesive 122 to flow into any discontinuities in the curl 112 and maintain a flat sealing surface 120 of the bottle seal 116. Any desired type of hot melt adhesive can be used and should be applied with a sufficient thickness on the bottle seal 116 to fill discontinuities in the curl 112, while maintaining a flat or contoured sealing surface 120. Of course, other types of adhesives can be used including epoxies, pressure-sensitive adhesives, self-drying adhesives, etc. In addition, the adhesive does not necessarily have to fill any discontinuities, as disclosed above. The bottle seal can be soft enough to fill discontinuities while still maintaining an adequate seal. Alternatively, the seal can be sufficiently hard to not deform in a manner that would prevent an adequate and reliable seal.

Figure 6:
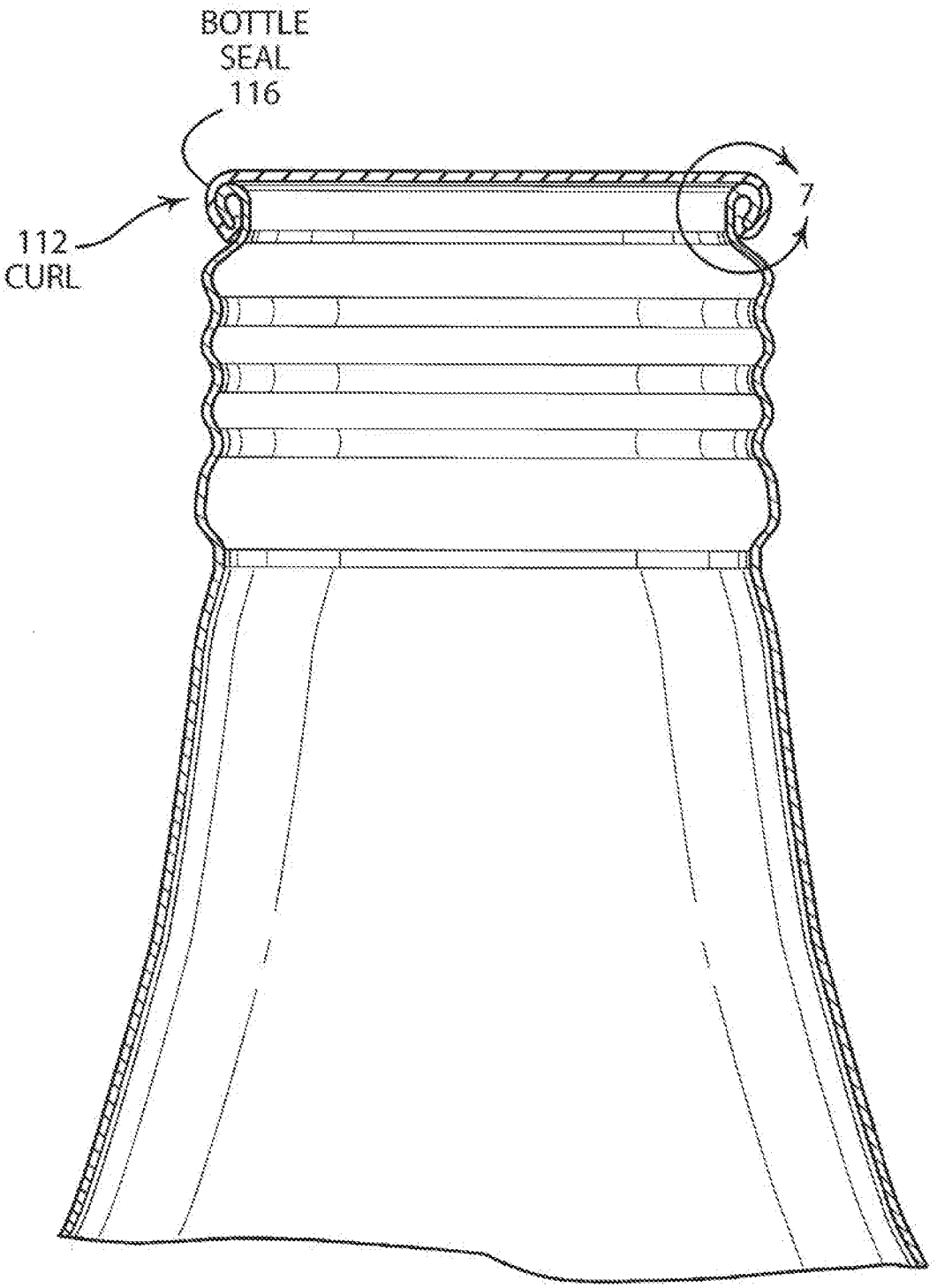
FIG. 6 is a schematic cutaway view of the bottle of FIG. 4 showing the crimped curl.

FIG. 6 is a schematic side cutaway view of the top of the metal bottle illustrating the curl 112 in a crimped configuration. As shown in FIG. 6, the bottle seal 116 is placed on the curl 112 as shown in FIGS. 4 and 5, and the curl 112 is then crimped to mechanically hold the bottle seal 116 in place. The mechanical pressure applied by crimping the curl onto the seal helps to hold the seal in a stationary and stable condition so that the seal does not fold or crease.

Figure 7:
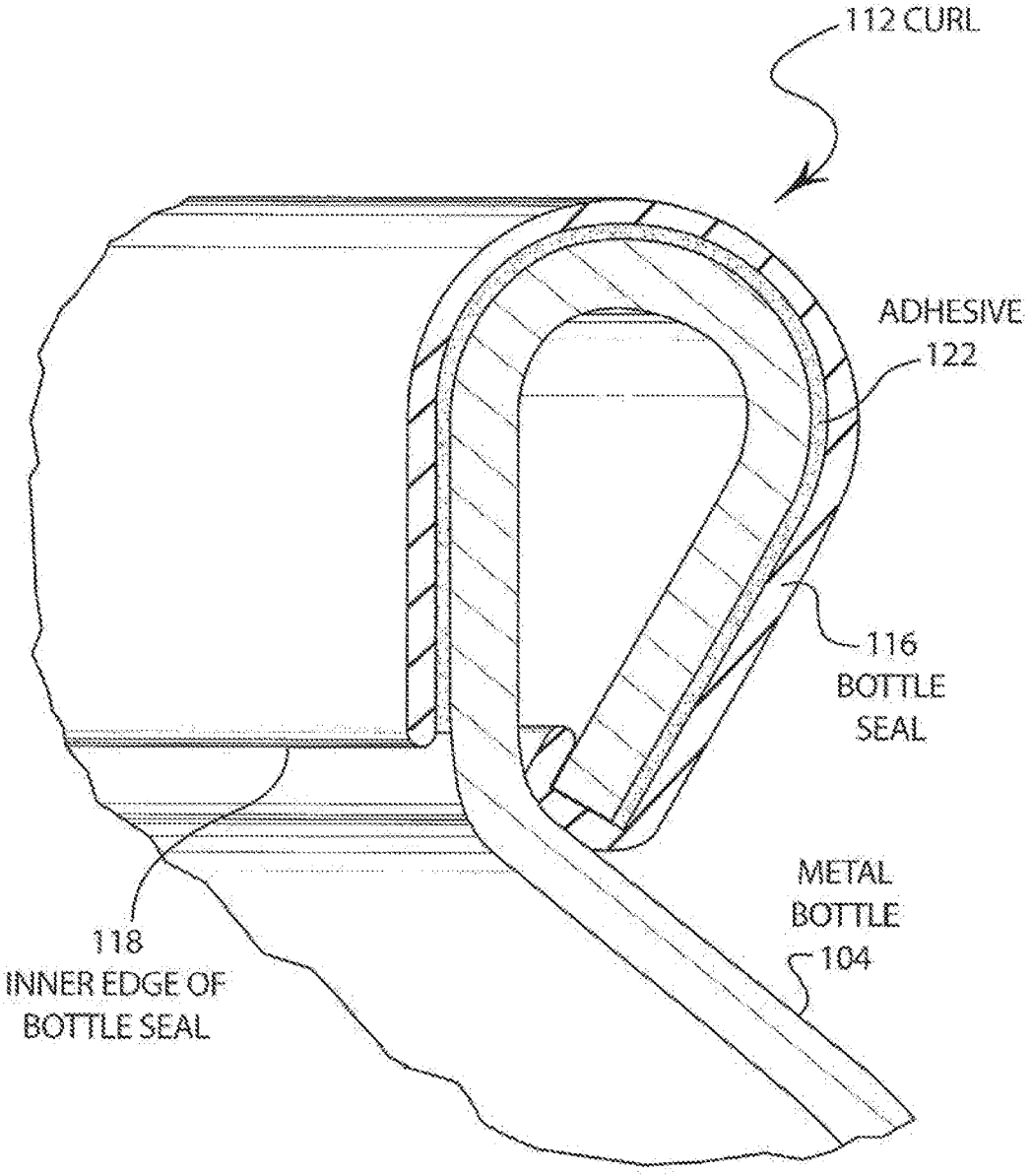
FIG. 7 is a close-up view of FIG. 6 illustrating the crimped curl and bottle seal.

FIG. 7 is a schematic cutaway close-up view of the curl 112 that is crimped onto the edge of the metal bottle 104. As shown in FIG. 7, the bottle seal 116 is crimped in between the curl 112 and the edge of the metal bottle 104. The J-hook in the bottle seal 116 is folded under the end of the curl so that the bottle seal 116 is securely wedged in between the metal bottle 104 and the curl 112. In addition, the adhesive 122, as described above, assists in holding the bottle seal 116 on the outer surface of the curl 112. As shown in FIG. 7, the edge of the seal 118 extends into the interior portion of the bottle and helps to seal any discontinuities in the FDA coating that result from the drawing and ironing of the metal in the curl 112. In addition, the bottle seal 116 seals the contact surfaces that a user's mouth may touch during the process of drinking from the metal bottle 104. In this fashion, metallic taste is not transmitted to the user's mouth, and an adequate coating is provided to prevent metal contamination resulting from discontinuities in the FDA coating as a result of the working of the metal of the curl 112.

Figure 8:
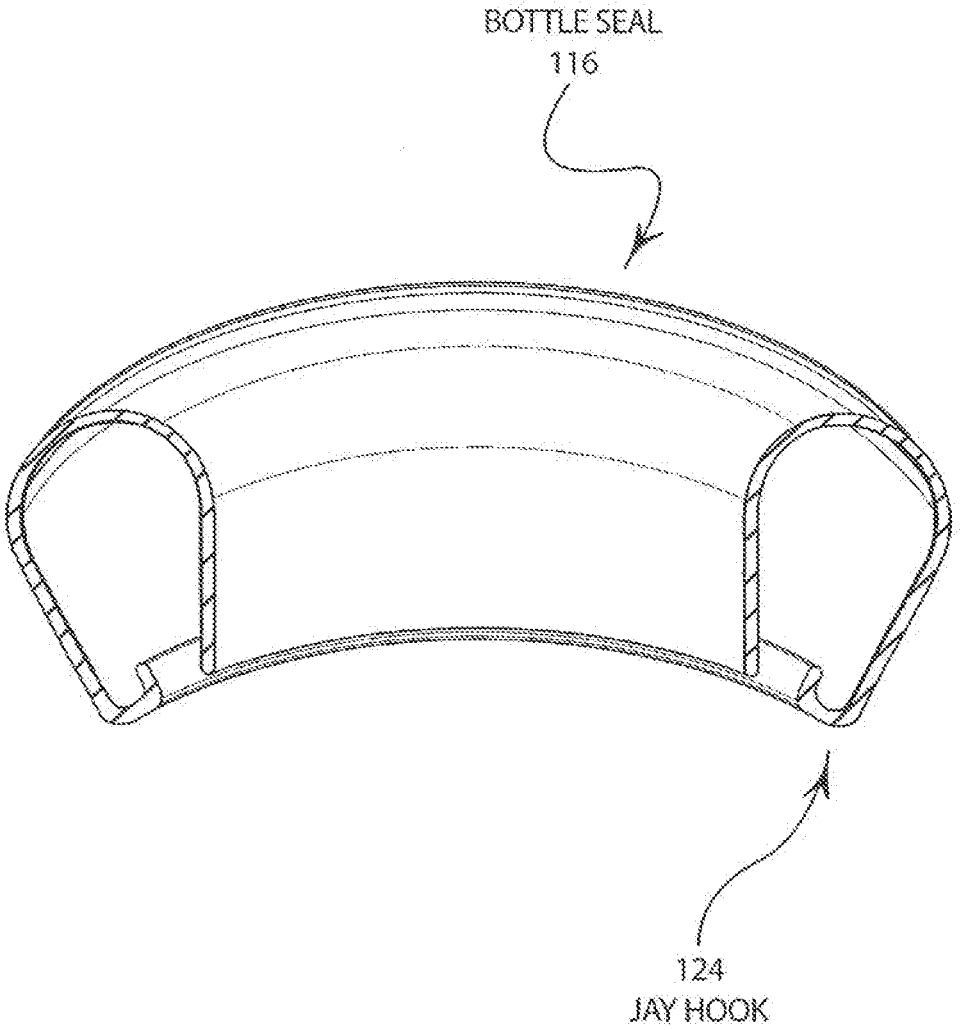
FIG. 8 is an isometric partial view of one embodiment of a bottle seal.

FIG. 8 is a cutaway view illustrating a preformed bottle seal 116. As described above, the bottle seal 116 is formed in an annulus so that there are no discontinuities when the bottle seal 116 is applied to the curl 112 of the metal bottle 104. The preforming of the bottle seal 116 in an annulus can be achieved by any desired method including heating of the annulus in die or mold. A J-hook 124 can be formed along one of the edges of the annulus of the bottle seal so that bottle seal 116 can be simply pressed on or popped onto the curl 112 of the metal bottle 104. Various automated methods can be used to apply the metal seal annulus 116 to the curl using standard pick and place automated machinery.

Figure 9:
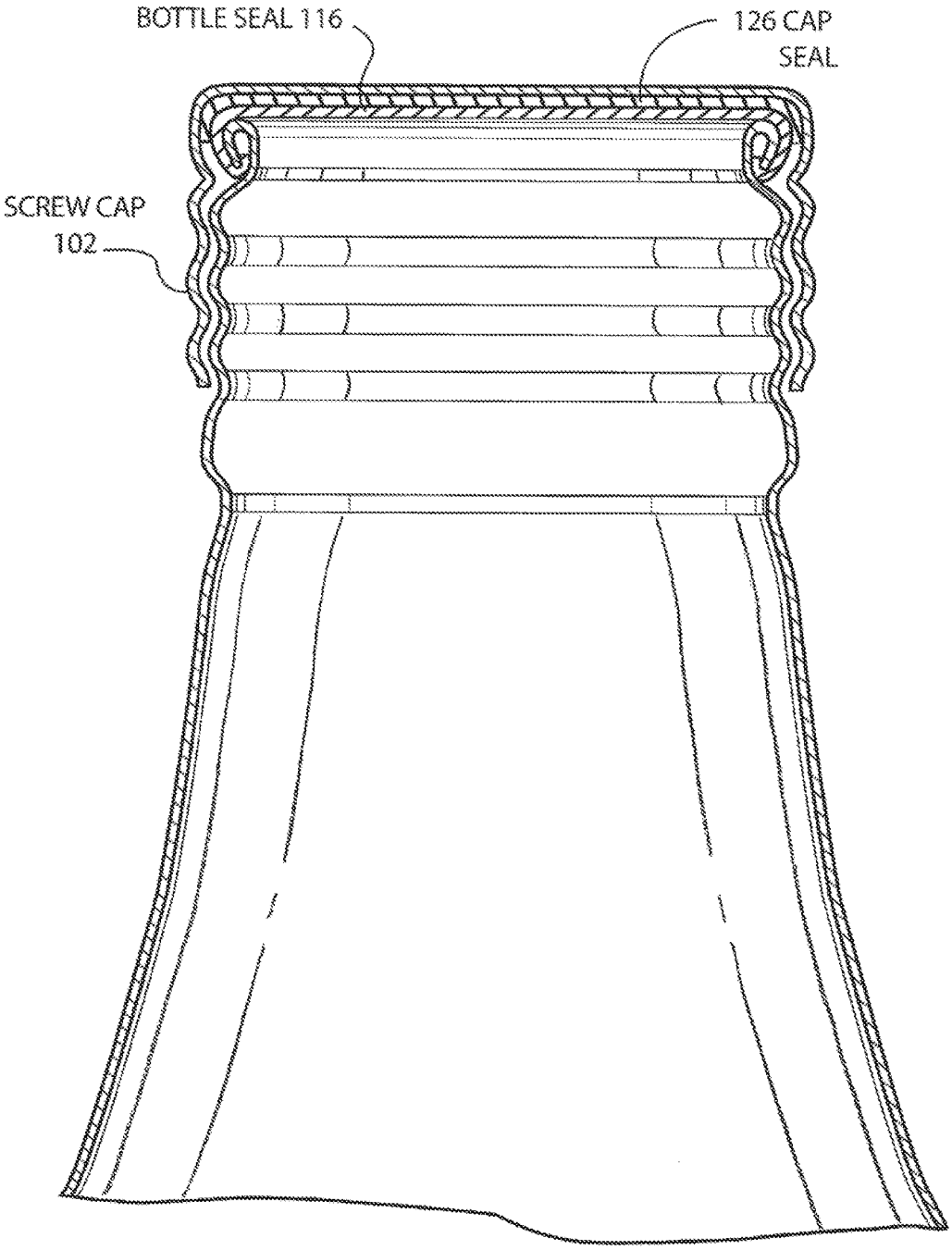
FIG. 9 is a cutaway view illustrating another embodiment of the present invention.

FIG. 9 is a schematic cutaway view of another embodiment of the present invention. In accordance with the embodiment of FIG. 9, both a cap seal 126 and a bottle seal 116 are used to ensure an adequate and reliable seal. The cap seal 126 may comprise a conventional cap seal that is used along the top inner surface of the screw cap 102. The cap seal is made from a standard sealing type of material. The cap seal is attached with either glue or is friction fit into the top inner portion of the screw cap 102. The bottle seal 116 interfaces in a preformed groove in the cap seal 126 in the same manner that the top sealing surface of a plastic bottle interfaces with the cap seal 126. Bottle seal 116 is formed and placed on the metal bottle in the same manner as described above. The materials for the bottle seal 116 and the cap seal 126 can be selected so that an adequate and reliable compression contact seal can be formed, while the torque/shear requirements have been reduced. These materials can be selected so that the compression pressure that is required to create an adequate and reliable seal is substantially lower than the 300 pounds per square inch that is typically required by conventional screw caps. In this manner, the structural rigidity of the metal bottle 104 can be reduced, i.e., the sidewalls of the metal bottle 104 can be thinner. Again, this is an advantage that can reduce the cost of the metal bottle 104 and provide a lighter, more marketable container.

In addition, in accordance with another embodiment, the bottle seal 116 and cap seal 126 can be replaced with an adhesive sealant that provides an adequate seal and is capable of breaking in response to low sheer forces, such as the forces that would be applied to screw cap 102 to remove the screw cap 102. In that regard, an adhesive sealant can be applied around the top portion of the curl 112 prior to placing the screw cap 102 on the metal bottle 104. The adhesive sealant comprises a material that is capable of providing an adequate seal while allowing the screw cap 102 to be removed with fairly low sheer forces. Various types of adhesive sealants can be used for this purpose, including adhesives that have directional properties. The advantage of using an adhesive seal is that substantially lower pressures are required to create a seal when applying the screw cap 102. These lower downward pressures allow the use of thinner sidewalls in the metal bottle, which results in bottles that are lighter and much less expensive.

Figure 10:
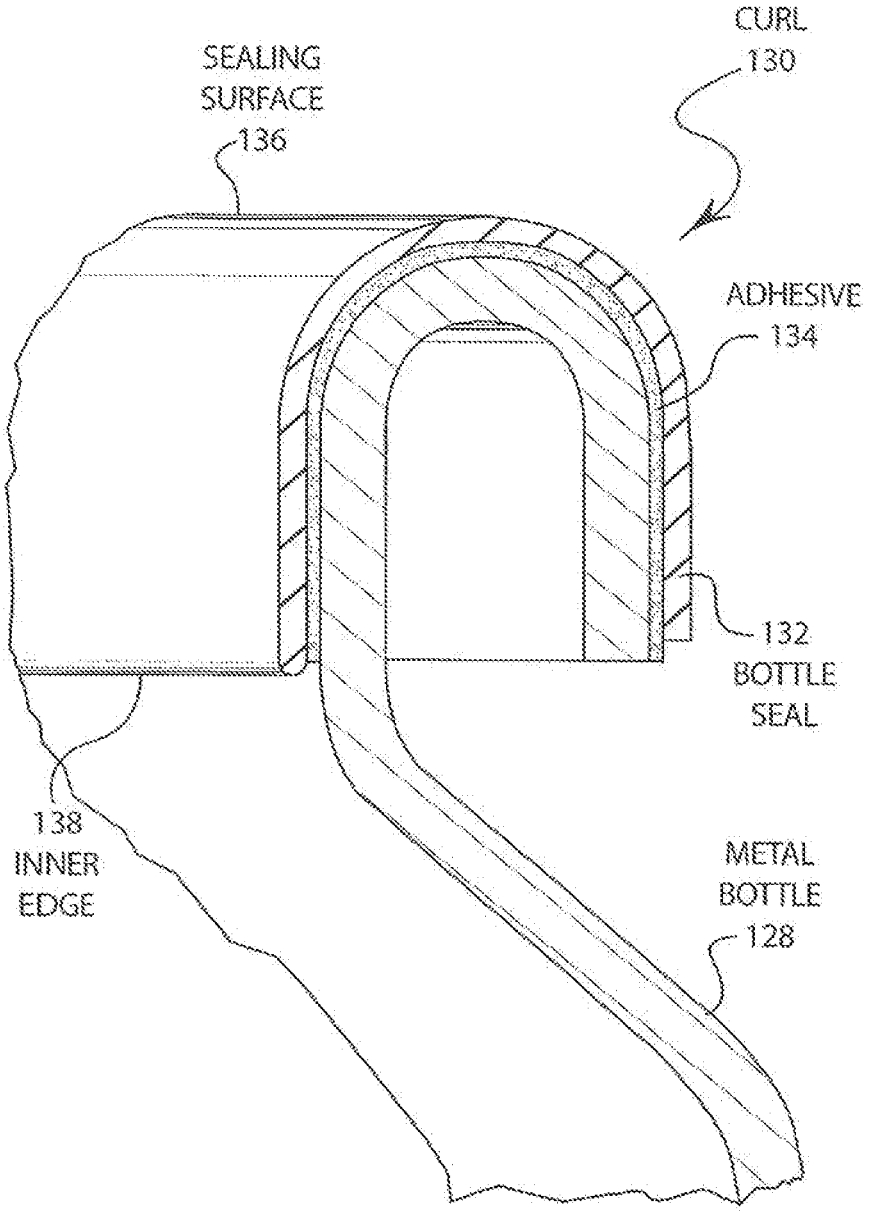
FIG. 10 is an isometric view of another embodiment of a bottle seal.

FIG. 10 is an illustration of another embodiment. In accordance with the embodiment of FIG. 10, a bottle seal 132 is attached to a curl 130 and metal bottle 128 using an adhesive 134. As shown in FIG. 10, the bottle seal 132 does not wrap around the inside of the curl 130, but extends to approximately the lower edge of the curl 130. In the other direction, the bottle seal 132 wraps around the curl 130 and has an inner edge 138 that extends to an interior portion of the metal bottle 128. The bottle seal 132 creates an adequate and reliable seal having a sealing surface 136. In accordance with the embodiment shown in FIG. 10, the curl is not crimped to hold the bottle seal 132, but remains in the position shown in FIG. 10 using adhesives, such as adhesive 134, or by other methods. For example, the bottle seal 132 can be attached to the curl 130 using sealing materials that cause the bottle seal 132 to adhere directly to the curl 130. For example, this may be accomplished using some materials by heating and pressing the bottle seal onto the curl 130.

Figure 11:
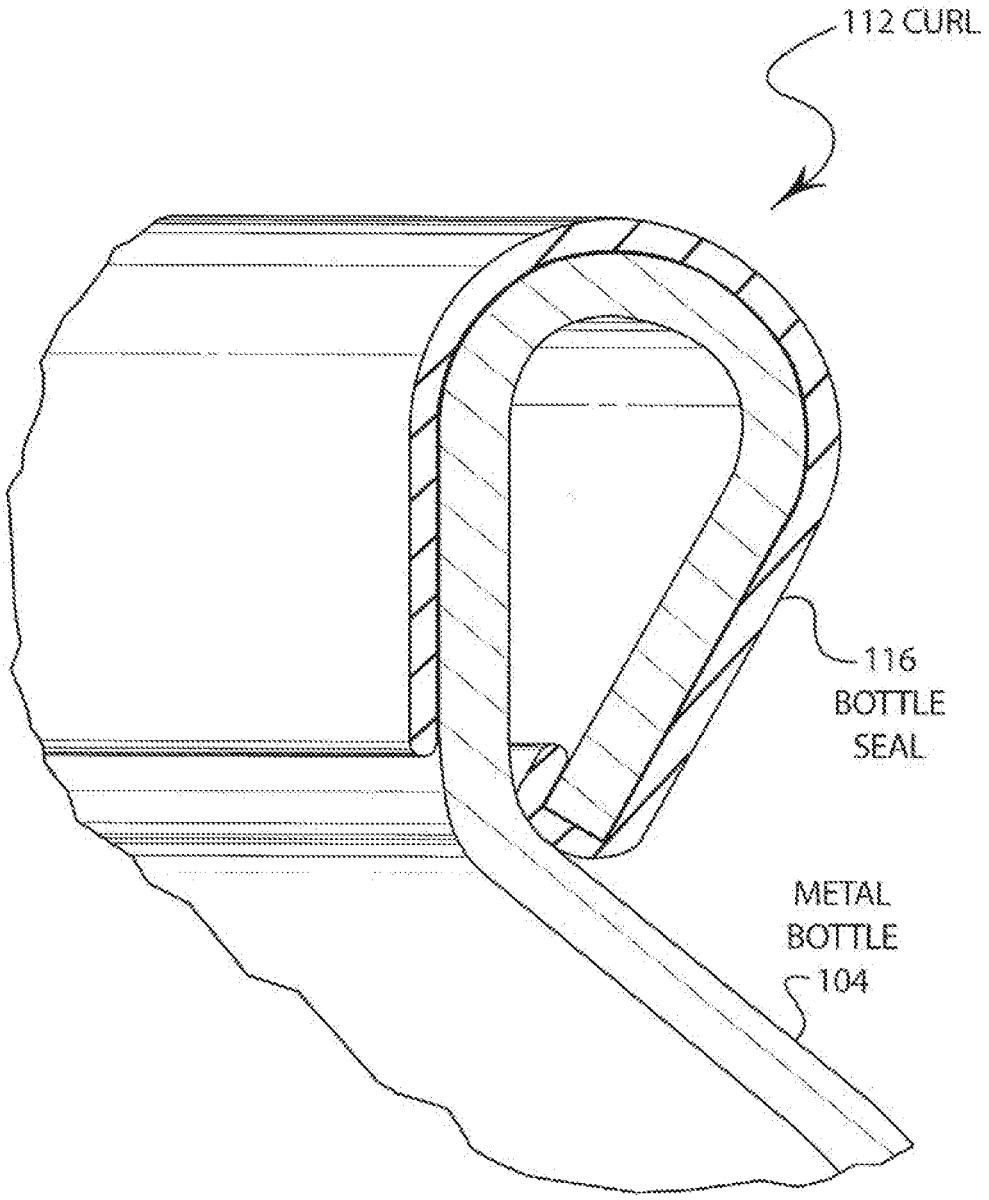
FIG. 11 is an isometric view of another embodiment of a bottle seal.

FIG. 11 is a schematic diagram of an embodiment that is similar to the embodiment of FIG. 7 that does not use an adhesive 122, such as disclosed in FIG. 7. Rather, the bottle seal 116 may be form fit and pressed onto the curl 122 and held in place by the crimping of the curl 122 onto the edge of the metal bottle 104. In addition, the bottle seal 116 may also adhere directly to the curl 122 by using materials for bottle seal 116 that can be heated to adhere to the metal of the curl 122.

Figure 12:
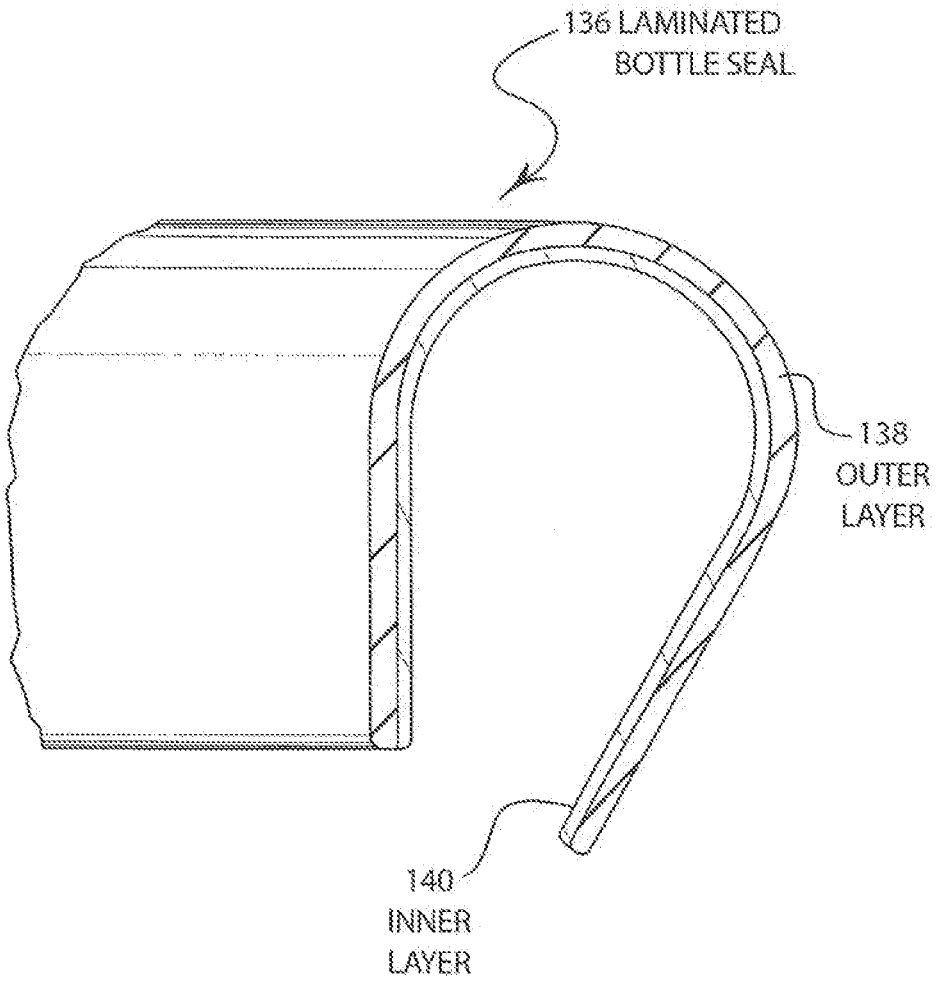
FIG. 12 is a close-up cutaway view of a laminated bottle seal.

FIG. 12 is a close-up cutaway view of a laminated bottle seal 136. As shown in FIG. 12, the laminated bottle seal 136 has an outer layer 138 that is laminated to an inner layer 140. The materials used for outer layer 138 and inner layer 140 can be selected to meet the desired requirements of the bottle. For example, but not by way of limitation, inner layer 140 can be a softer material that is capable of filling the discontinuities in the bottle curl. Outer layer 138 can be a harder layer that is capable of creating an adequate and reliable seal. Also, by way of example, and not limitation, inner layer 140 can be a layer of material that self-adheres to the metal of the bottle curl or can be heated to adhere to the metal of the bottle curl.

Figure 13:
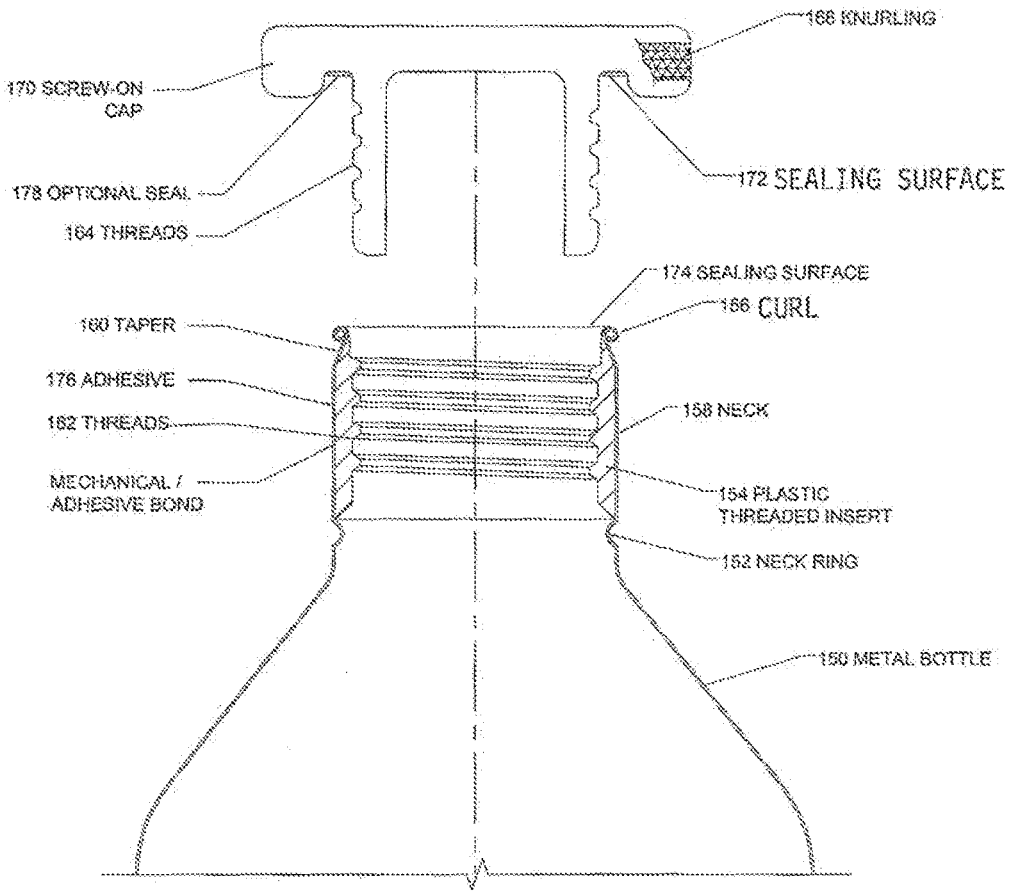
FIG. 13 is a schematic cutaway view of another embodiment that uses an internal plastic threaded insert with an externally threaded screw-on cap.

FIG. 13 is a schematic cutaway view of another embodiment. As shown in FIG. 13, an internally threaded screw-on cap 170 can be used to seal a metal bottle 150. The metal bottle 150, that is illustrated in FIG. 13, has a neck portion 158 that extends outwardly from the body of the metal bottle 150. At the upper end of the neck 158, a curl 156 is formed that creates a sealing surface 174. A plastic threaded insert 154 is mechanically held in the neck 158 by the taper 160 and neck ring 152. The taper 160 prevents the plastic threaded insert 154 from being pulled out of the neck 158. Neck ring 152 prevents the plastic threaded insert 154 from being pushed into the metal bottle 150. Adhesive 176 adheres the plastic threaded insert 154 to the inner surface of the neck 158, which prevents the plastic threaded insert 154 from rotating in the neck 158 and also assists in preventing the plastic threaded insert 154 from being pulled out of or pushed into the metal bottle 150. Additionally, a pressure relief mechanism may be incorporated into the metal bottle 150 or into the screw-on cap 170 whereby the pressure may be relieved or vented to equalize the pressure within the metal bottle 150 to the atmosphere. This pressure relief may be a one-time release, such as a pull tab or piercing mechanism, or in the form of a relief valve that may be subjected to multiple uses when the bottle is resealed.

As also shown in FIG. 13, threads 162 are formed in the plastic threaded insert 154 that match the threads 164 of the screw-on cap 170. As a result, the screw-on cap 170 can be inserted in the plastic threaded insert 154 and screwed tightly into the plastic threaded insert 154 that is disposed in the neck 158, so that the sealing surface 174 at the top of the curl 156 abuts against the sealing surface 172 of the screw-on cap 170. A bottle seal, such as the bottle seals disclosed in other embodiments, can be placed on the curl 156 to form the sealing surface 174, if desired, to seal to the sealing surface 172 of screw-on cap 170. Alternatively, the sealing surface 172 can be covered with an optional seal 178 having a desired density and hardness that is capable of providing an airtight seal with the sealing surface 174, that may include discontinuities, breaks, cracks, or an otherwise irregular surface. In that regard, the material of the screw-on cap 170 can be made from a material that has the proper density and hardness/softness to provide such a desired seal. For example, materials such as flexible PVC, flexible vinyl, flexible urethane, thermoplastic rubber, silicon, or other similar materials can be used. Knurling 168 may also be included on the screw-on cap 170 to assist the user in removing and inserting the cap 170. Since the taper 160 mechanically holds the plastic threaded insert 154, so that the plastic threaded insert 154 cannot be removed from the bottle, the taper 160 may be formed after the plastic threaded insert 154 is inserted into the neck 158 of the metal bottle 150.

Figure 14:
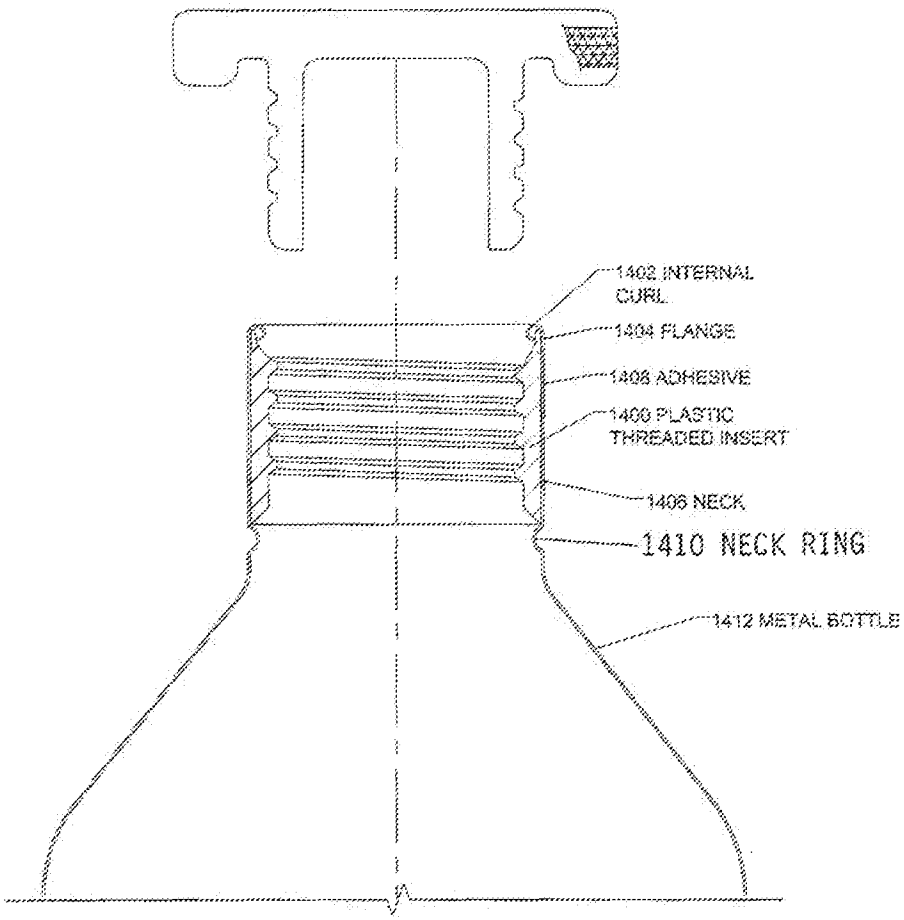
FIG. 14 is a schematic cutaway view of another embodiment that uses an internal plastic threaded insert with optional sealant material.

FIG. 14 is a cutaway view of another embodiment that uses an internal plastic threaded insert 1400. As shown in FIG. 14, the plastic threaded insert 1400 is inserted in the neck 1406 and abuts against the neck ring 1410 so that the plastic threaded insert 1400 cannot be pushed into the interior portion of the metal bottle 1412. An adhesive 1408 is then used to secure the plastic threaded insert 1400 to the inside surface of the neck 1406. The plastic threaded insert 1400 is also held in place by the internal curl 1402. Internal curl 1402 is curled inwardly into the opening of the neck 1406 and mechanically engages and clamps a flange 1404 of the plastic threaded insert 1400. The internal curl 1402 secures the plastic threaded insert 1400 so that the plastic threaded insert 1400 cannot be pulled outwardly from the neck 1406 and also securely holds the plastic threaded insert 1400 so that the plastic threaded insert 1400 will not rotate in the neck 1406. In that regard, the use of the adhesive 1408 may not be necessary in the embodiment illustrated in FIG. 14, since the internal curl 1402 securely holds the plastic threaded insert 1400 in a manner that prevents both rotation of the plastic threaded insert 1400 in the neck 1402 and prevents the plastic threaded insert 1400 from being pulled out of the neck 1406.

Figure 15:
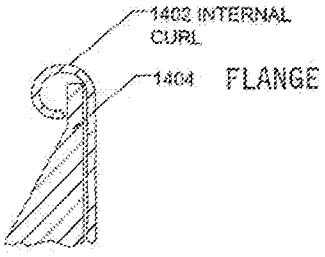
FIG. 15 is a cutaway view of a portion of the embodiment illustrated in FIG. 14.

FIG. 15 is a close-up sectional view of a portion of the embodiment illustrated in FIG. 14. As shown in FIG. 15, the flange 1404 is mechanically held in place by the internal curl 1402. The internal curl 1402 is formed after the plastic threaded insert 1400 is inserted in the neck 1406. The internal curl 1402 is wrapped around the flange 1404 and mechanically holds the flange 1404 securely in place, so that the plastic threaded insert 1400 cannot be removed from the neck 1406 of the metal bottle 1412 and cannot rotate in the neck 1406.

Figure 16:
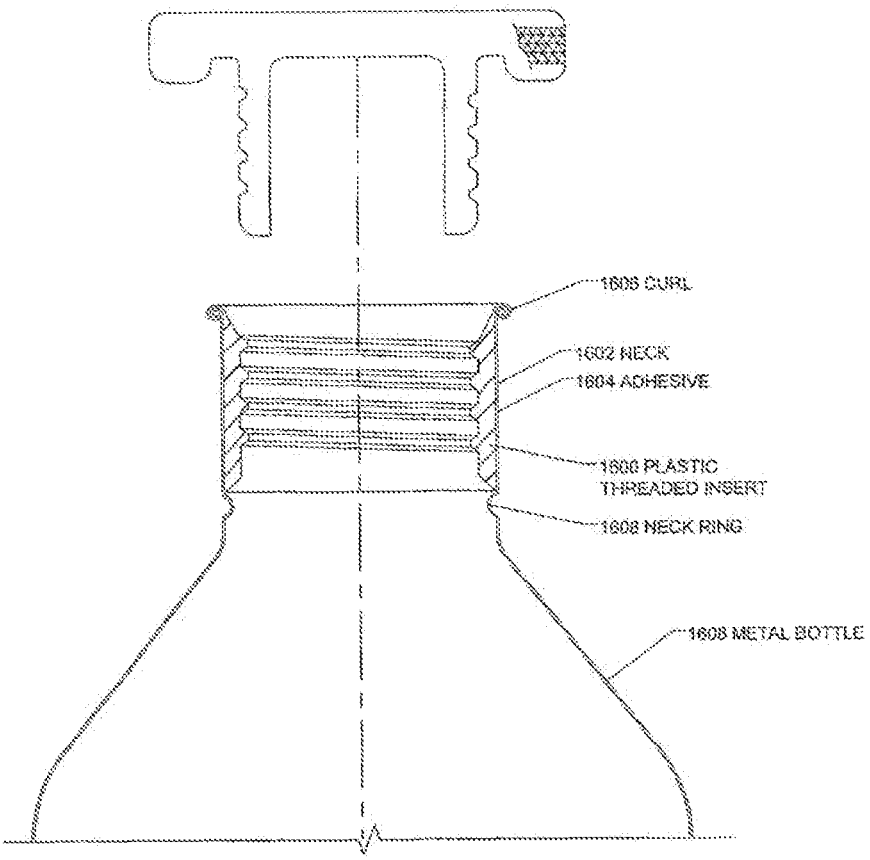
FIG. 16 is a schematic cutaway view of another embodiment of a plastic threaded insert.

FIG. 16 is a schematic illustration of another embodiment. As shown in FIG. 16, the plastic threaded insert 1600 is inserted into the neck 1602 after the formation of the curl 1606. The plastic threaded insert 1600 abuts against the neck ring 1608, so that the plastic threaded insert 1600 does not pass into the metal bottle 1608. An adhesive 1604 holds the plastic threaded insert 1600 to the interior surface of the neck 1602. The advantage of the system illustrated in FIG. 16 is that the plastic threaded insert 1600 can be inserted into the neck 1602 after the curl 1606 is formed.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A metal bottle and sealing system structured to cooperate with a cap to retain a liquid, said cap having a distal portion and a protrusion extending therefrom, said protrusion including a threaded portion having a first diameter, wherein said metal bottle and sealing system comprises:

a first end defining an opening structured to be sealed by said distal portion of said cap, the first end having a second diameter;

a second end disposed opposite and distal the first end, the second end having a third diameter larger than the second diameter; and a neck portion having an interior and an exterior, said neck portion extending from the first end toward the second end, wherein the first end includes a curl structured to cooperate with said sealing system to facilitate sealing of said bottle opening, said curl having a fourth diameter greater than the first diameter;

wherein said neck portion is threaded only on said interior;

wherein the interior of said neck portion is threadably engaged with said threaded portion of said cap; wherein said sealing system further comprises an annular-shaped bottle seal having an inner layer and an outer layer laminated to said inner layer; wherein said outer layer is made of a first plastic material in order to prevent metallic taste from being transmitted from said metal bottle to a user; wherein said inner layer is made of a second plastic material softer than the first plastic material in order to fill discontinuities in said curl; and wherein said curl is structured to engage said inner layer.

2. The metal bottle and sealing system of claim 1 wherein said curl extends outwardly from the interior; and wherein said curl has a distal terminating end surface spaced from the exterior.

3. The metal bottle and sealing system of claim 2 wherein a portion of said bottle seal is crimped between the distal terminating end surface of said curl and the exterior of said neck portion.

4. The metal bottle and sealing system of claim 1 wherein said sealing system further comprises an adhesive for adhering said bottle seal to said curl.

5. The metal bottle and sealing system of claim 1 wherein said curl comprises a sealing surface; and wherein said bottle seal extends over said sealing surface from the interior to the exterior.

6. The metal bottle and sealing system of claim 1 wherein said curl curls outwardly from the interior to the exterior; wherein said curl has a distal terminating end surface; wherein said bottle seal has a J-hook formed therein; and wherein said J-hook is folded under said distal terminating end surface so that said bottle seal is securely wedged in between said distal terminating end surface and an exterior of said metal bottle.

7. The metal bottle and sealing system of claim 1 wherein said exterior of said neck portion is not threaded.

8. The metal bottle and sealing system of claim 1 wherein said exterior of said neck portion is generally smooth.

9. The metal bottle and sealing system of claim 1 wherein said curl curls inwardly from the exterior to the interior.

10. The metal bottle and sealing system of claim 1 wherein at least one of said metal bottle and said cap has a pressure relief mechanism in order to equalize pressure within said metal bottle to an atmospheric pressure.

11. The metal bottle and sealing system of claim 10 wherein said pressure relief mechanism is a pull tab.

12. The metal bottle and sealing system of claim 10 wherein said pressure relief mechanism is a piercing mechanism.

13. The metal bottle and sealing system of claim 10 wherein said pressure relief mechanism is a relief valve.

14. The metal bottle and sealing system of claim 1 wherein the threaded engagement between said interior of neck portion and said threaded portion of said protrusion of said cap is the only mechanism by which said cap is connected to said metal bottle.

15. The metal bottle and sealing system of claim 1 wherein said metal bottle is made entirely of aluminum.

16. A bottle assembly comprising:

a cap having a distal portion and a protrusion extending therefrom, said protrusion including a threaded portion having a first diameter, and a metal bottle comprising:

a first end defining an opening structured to be sealed by said distal portion of said cap, the first end having a second diameter, a second end disposed opposite and distal the first end, the second end having a third diameter larger than the second diameter, and a neck portion having an interior and an exterior, said neck portion extending from the first end toward the second end, wherein the first end includes a curl having a fourth diameter greater than the first diameter, wherein said neck portion is threaded only on said interior, wherein the interior of said neck portion is threadably engaged with said threaded portion of said cap; wherein said bottle assembly further comprises an annular-shaped bottle seal having an inner layer and an outer layer laminated to said inner layer; wherein said outer layer is made of a first plastic material in order to prevent metallic taste from being transmitted from said metal bottle to a user; wherein said inner layer is made of a second plastic material softer than the first plastic material in order to fill discontinuities in said curl; and wherein said curl is structured to engage said inner layer.

17. The bottle assembly of claim 16 wherein said exterior of said neck portion is not threaded.

18. The bottle assembly of claim 16 wherein said curl curls inwardly from the exterior to the interior.

* * * * *